US005829496A

United States Patent [19]

Campbell

[11] Patent Number: 5,829,496

[45] Date of Patent: Nov. 3, 1998

[54] FINISHING DEVICE

[75] Inventor: Printess Campbell, Lancaster, Ky.

[73] Assignee: Saturn Tool Company, LLC, Danville, Ky.

[21] Appl. No.: 842,366

[22] Filed: Apr. 24, 1997

[51] Int. Cl.[6] ..... B27C 9/00; B27C 5/00

[52] U.S. Cl. ..... 144/2.1; 30/329; 144/147; 144/363; 144/369

[58] Field of Search ..... 144/2.1, 147, 363, 144/369; 30/167, 169, 172, 279.2, 280, 329, 353

[56] References Cited

U.S. PATENT DOCUMENTS 854,725 5/1907 Devers ..... 144/147
4,840,209 6/1989 Rebeau .
4,932,450 6/1990 Baker .
5,415,211 5/1995 Susnjara et al. .
5,547,000 8/1996 Susnjara et al. .

*Primary Examiner*—W. Donald Bray
*Attorney, Agent, or Firm*—Kenneth F. Pearce

[57] ABSTRACT

A device for finishing the corner of an impression of the profile. Corners of impressions of doors manufactured in one-piece are shaped to give the appearance of a mitered joint where a joint does not exist. By selecting the appropriate cutter, sides of the corners of differing profiles can be mitered to corresponding forty-five degree angles relative to the square of the corner.

19 Claims, 2 Drawing Sheets

FINISHING DEVICE

BACKGROUND OF THE INVENTION

1. Field of the Invention

The present invention is directed toward the shaping of the corner of an impression found on the profile of a one-piece door. It has been found that the finishing device is especially useful for shaping the corners of cabinet doors, but other one-piece doors can also have their profiles shaped by the invention. Manual operation of the finishing device on corners of one-piece doors imparts the visual impression of a miter line which is commonly found at the corners of a multi-piece door. The cutter of the present invention can be contoured to shape a miter line of any predetermined angle for an impression of any preselected size, but it has been found that the finishing device is especially useful for creating a miter line of forty-five degrees relative to the square of the corner. Importantly, as the present invention travels over the profile, the resultant impression can be furnished with sufficient smoothness to eliminate the necessity of sanding.

2. Description of the Previous Art a) U.S. Pat. No. 4,932,450-Baker discloses a machine and a method for forming inside corners in a one-piece article. Primarily, Baker's machine requires the combined use of a work table having a pair of opposite hand cutter assemblies mounted thereto for shaping the corners of the profile. Each cutter assembly has either a pneumatic or hydraulic cylinder for reciprocally actuating the sheer cutter. As the sheer cutters miter the corner of the profile, spring pressure is required to insure proper seating of the cutters in their respective grooves. At the same time, adjustable stops are necessary to prevent the cutters from overshooting their predetermine marks for their respective miter line positions. If it were not for the mechanical stops, the adjacent grooves of the profiles would be blemished and unusable. And another inconvenient limitation to the practice of Baker's machine is that only one of the cutter assembles can be activated at a time.

b) U.S. Pat. No. 5,547,003-Susnjara, et al., discloses a method and a device for forming squared inside corners on raised panels. The Susnjara apparatus combines high frequency oscillations with a tool bit having either an abrasive bottom or a set of blades secured to its side surfaces. As the tool bit engages the workpiece, its corners may be squared. Importantly, the object of U.S. Pat. No. 5,547,003 is to provide a computer controlled machine which first routs a rounded groove and then forms a squared corner in the groove. And the comprehensive purpose of the Susnjara apparatus is to rapidly and sequentially form squared corners from the former rounded corners in the workpiece.

c) U.S. Pat. No. 4,840,209-Reneau enables a router guide assembly and method of using the router on a workpiece. Reneau teaches the mounting of a router trolley on a single rail which has been secured to the workpiece.

d) U.S. Pat. No. 5,415,211-Susnjara, et. al., discloses an apparatus for producing square inside corners on a workpiece. The Susnjara machine can only operate at high speeds. In operation, a cutting blade is attached to the bottom of an oscillating plate to cut the surface of the workpiece at a forty-five degree angle.

SUMMARY OF THE INVENTION

The present invention is a finishing device which is particularly useful for shaping the corner of an impression of a profile of a door. Although the finishing device is intended for manual operation, it has been unexpectedly determined that about as many corners per minute can be squared with the present invention, as with the more expensive computerized or mechanized machines already available in the industry. And the finishing device can repetitively reproduce miter lines, with the same quality of appearance as the more expensive electromechanical machines already available in the art.

The tool is especially effective for shaping corners of doors composed of medium density or high density fibers, such as those commonly found in the cabinet-door industry. However, the finishing device can also be utilized to shape the impressions formed by other substances, e.g., petrochemical byproducts or plastics. Importantly, the present invention is capable of cutting the impression to such a smooth finish that subsequent sanding of the impression is eliminated.

An object of the present invention is to provide a tool for shaping a corner of an impression of a one-piece door.

Another object of the present invention is to provide a manual tool for mitering the corner of an impression of a one-piece door which eliminates the necessity of powerized or computerized mechanisms to shape the corner.

Still another object of the present invention is to provide a tool particularly useful in shaping the corner of a door composed of medium density fiber or high density fiber.

It is another object of the present invention to provide a tool which can be utilized with or without a track to guide the tool.

It is yet another object of the present invention to provide a tool capable of producing a miter line of forty-five degrees relative to the square of the corner.

It is still another object of the present invention to provide a tool of adequate weight to shape the impression without the requirement of including any other downward pressure.

Yet still another object of the present invention is to provide a tool capable of reproducing a miter line in such a manner to give the appearance that it was shaped by a powerized or computerized machine.

It is still another object of the present invention to provide a tool to shoulder cutters of varying contours.

Yet another object of the present invention is to provide a tool of utilizing blades of various contours to alter the miter line to a predetermined angle.

Still another object of the present invention to provide a tool to shoulder cutters of varying contours and widths depending upon the size of the impression being shaped.

As used herein, "mitering" is directed to the shaping of the profile of a one-piece door. Because a one-piece door is the subject of the practice of this invention, it is impossible for a corner to have a joint where different pieces of wood combine to form the joint. Thus, since there is no joint, the "miter line" cannot completely cross the thickness of the door. Therefore, "mitering" shall mean that the "miter line" shaped furnishes the visual imitation of an actual mitered joint on the one-piece door.

Until the present invention, the trend in the medium density fiber door industry was to add more and more components onto known electromechanical apparatus to accomplish what should be the rather simple task of squaring a corner. By including additional components to the already available machinery, it was anticipated the one-piece doors would have their corners more efficiently squared, while, at the same time, generating an improved overall appearance. Powerized complicated router systems with numerous attachments were tried, as were routers controlled by computer programs, or various combinations of attachments, machines and computers. High frequency oscillating cutters strained to impart a miter line in the corner of a one-piece door in hope of satisfying the long felt need within the industry. Then, there were machines designed to first rout and then further shape the corner. When compared with the finishing device, the prior machines are complex in construction and complicated to use. It is believed that prior to the present invention, a simple tool operated manually and capable of rapid and multiple reproductions of miter lines was unknown.

The present invention can be described as a tool for mitering a corner of an impression of a profile of a one-piece door, comprising: a cutter contoured for shaping the side of the corner and a carrier for manually moving the cutter against the corner which shapes the profile. It is the novel and unique interaction of these simple elements which creates the present finishing device.

A description of the preferred embodiment follows. And it is to be understood that the best mode description does not limit the scope of the present invention. The breadth of the present invention is identified in the claims appended hereto.

DESCRIPTION OF THE PREFERRED EMBODIMENTS

Although the disclosure hereof is detailed to enable those skilled in the art to practice the invention, the embodiments published herein merely exemplify the present invention which can be practiced in other specific structures.

Figure 1:
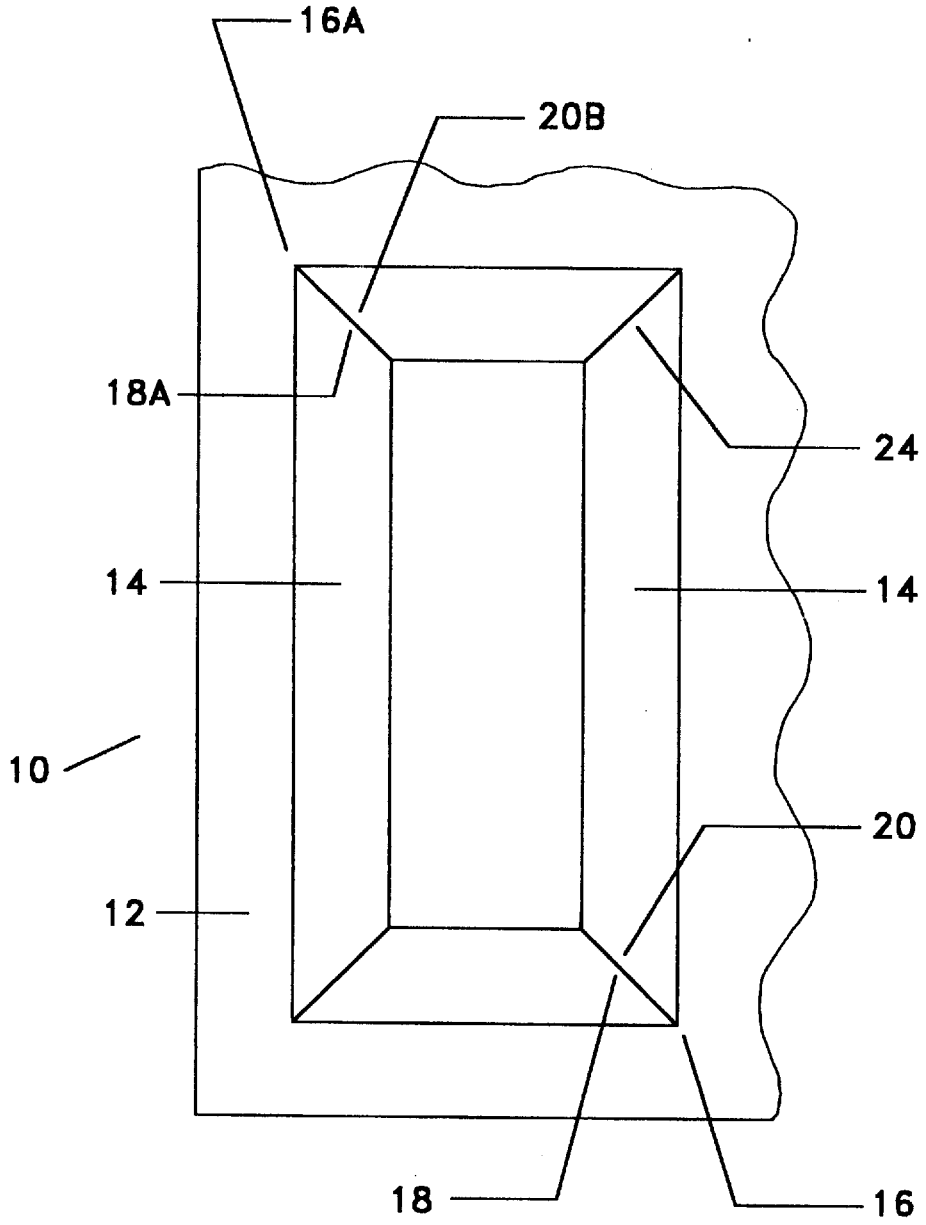
FIG. 1 is a frontal view of the profile of a one-piece door.

Both U.S. Pat. Nos. 4,932,450-Baker and 5,547,003 disclose that the rotary motion of the router produces rounded corners in the impressions of one-piece doors. With this well known fact in mind, FIG. 1 is a frontal view of a profile (12) of a one-piece door (10) were the corners (16 and 16*a*) have already been mitered by the present invention. Door (10) may include medium density fiber, high-density fiber, petrochemical byproducts or plastic components. Additionally, unlike the depiction of profile (12) of door (10), in FIG. 1, there can be more than one impression (14) of varying areas. By way of example, some cabinet doors can include four or more impressions, all of which are easily shaped by the present finishing device.

Corner (16) has first side (13) and second side (20) while corner (16*a*) has first side (13*a*) and second side (20*a*). As best shown, in the upper right hand portion of FIG. 1, miter line (24) separates the first and second sides of the various corners. In this particular adaptation of the present invention, a miter line (24) of forty-five degrees relative to the square of corner (16) is depicted. However, within the scope of the present finishing device, a miter line other than forty-five degrees relative to the square of the corner can also be achieved.

Figures 2, 3:
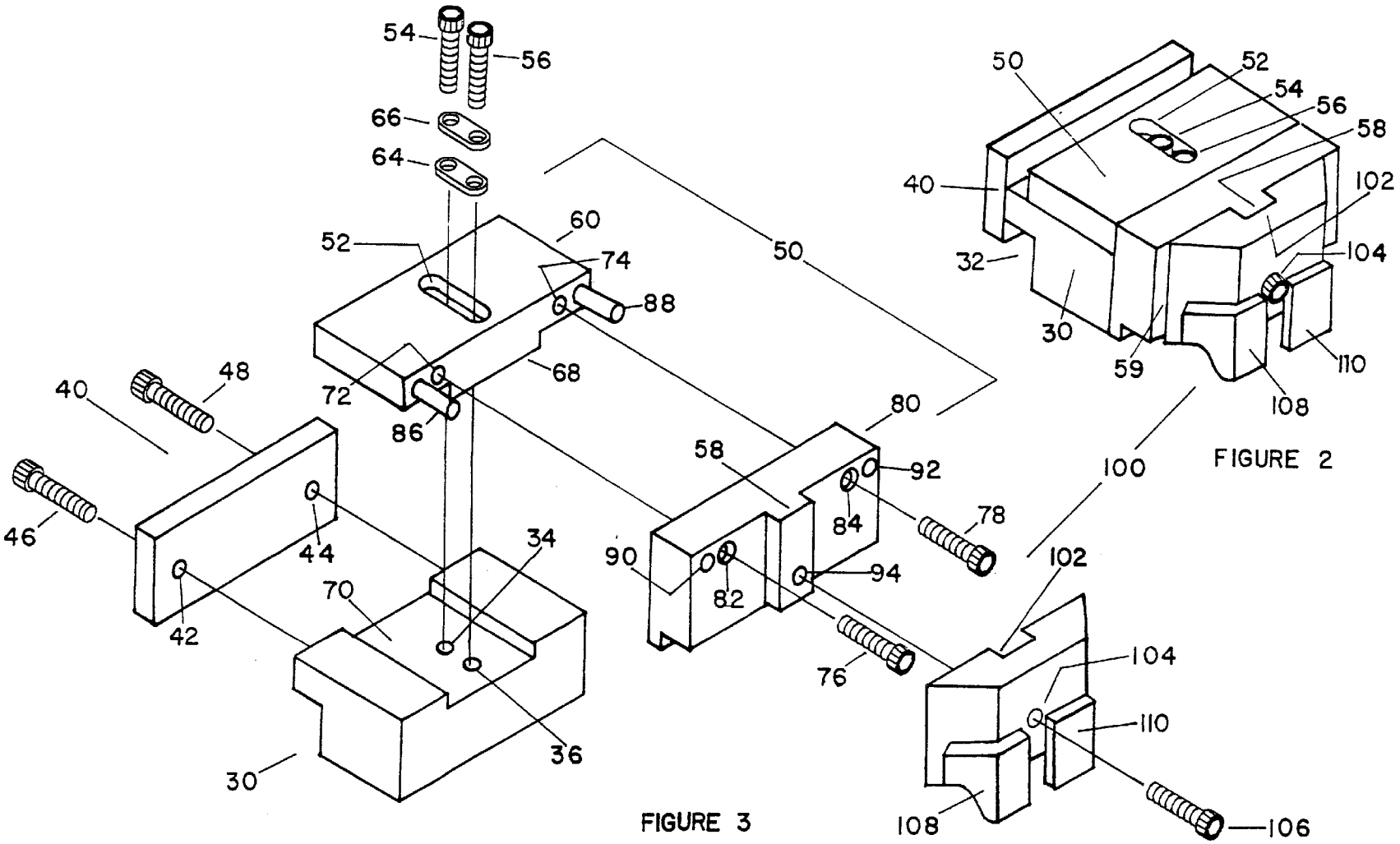
FIG. 2 is a pictorial view of the present invention.
FIG. 3 is an exploded view of the present invention.

Looking now at FIG. 2, a pictorial view, of one embodiment, of the assembled finishing device is shown. Carrier (30) is provided with catch (32) which runs the breadth of the backside of carrier (30). Catch (32) is manufactured with such dimension that it can engage a track or guide (not shown). When the operator of the present invention deems it necessary, the combination of catch (32) and the guide (not shown) assist in directing the pathway of carrier (30).

Arm (50) is provided with slot (52) which allows arm (50) to be adjusted as the workpiece (not shown) may dictate. In the specific embodiment, slot (52) permits arm (50) a posterior-anterior adjustment of up to about 3.0 centimeters. Although not shown in FIG. 2, carrier (30) has at least one threaded bore for receiving a bolt which couples arm (50) to carrier (30). In this specific embodiment, as is better demonstrated, when comparing FIGS. 2 and 3, bolts (54) and (56) extend respectively through slot (52) and are tightened into threaded bores (34) and (36) to secure arm (50) to carrier (30).

Arm (50) includes extension (58) for reciprocating with aperture (102) of cutter (100). As is better visualized when comparing FIGS. 2 and 3, opening (104) extends through cutter (100) and is aligned with a threaded bore (94) recessed within front (59) of arm (50). Bolt (106) fastens cutter (100) to arm (50). By way of illustration, the interfacing between aperture (102) of cutter (100) and extension (58) of arm (50) assists in stabilizing cutter (100) as it is moved rectilinearly to miter a first side (18) of corner (16) of one-piece door (10).

As illustrated in FIGS. 2 and 3, cutter (100) is equipped with contoured blades (108) and (110). And as the dimensions for a preferred embodiment more precisely hereinafter identify, blades (108) and (110) of cutter (100) are contoured radially to shape the impression (14) of profile (12). However, if the workpiece mandates, cutter (100) can also be equipped with a cutter having a single cutting surface. For example, cutter (100) can be milled in such a manner as to form a single cutting edge, thereby eliminating the necessity of blades. Further, and still within the scope of the present invention, cutter (100) can be fitted with a straight-edge cutting surface rather than a contoured cutting surface.

Depending upon the area of the impression (14) of profile (12), blades (108) and (110) are contoured to miter first and second sides (18 and 20) of corner (16), as well as first and second sides (18*a* and 20*a*) of corner (16*a*). Until blades (108) and (110) are exchanged for differently contoured blades or become dull, the present invention will repetitively continue to reproduce identical miter lines (24) on impression (14), for as long as desired by the operator of the finishing device. As shown in FIGS. 2 and 3, two blades (108) and (110) are fixed to cutter (100). However, when the need arises, more than two blades can be attached to cutter (100). In the present embodiments, blades (108) and (110) are welded to cutter (100), but the blades (108) and (110) can be attached to cutter (100) in any means accepted within the art.

Turning now to FIG. 3, novel features of another embodiment of the present invention are disclosed. Carrier (30) has threaded bores (not shown) recessed into its anterior side (not shown) to receive bolts (46) and (48). Back plate (40) is further supplied with holes (42) and (44) through which bolts (46) and (48) pass to affix back plate (40) to carrier (30). Unlike the embodiment shown in FIG. 2, catch (32) is functional only after back plate (40) is attached to carrier (30). Thus, the present finishing device can be utilized with or without catch (32) or any corresponding track (not shown).

Riding above carrier (30) is connector (60). Slot (52) of connector (60) is aligned over threaded bores (34) and (36) for receiving bolts (54) and (56). In this specific embodiment, slot (52) is larger than washers (64) and (66).

In operation, the combination of slot (52) and bolts (54) and (56) of the present invention permits connector (60) to be calibrated forward or backward as the workpiece may require.

Projecting downwardly from connector (60) is jut (68) for interlocking with corresponding notch (70) of carrier (30). On the anterior face of connector (60) threaded bores (72) and (74) are recessed and aligned to receive bolts (76) and (78). By extending bolts (76) and (78) through holes (82) and (84) and into threaded bores (72) and (74), shoulder (80) is secured to connector (60). Further stabilizing this particular embodiment, connector (80) is furnished with rods (86) and (88) which engage corresponding bores (90) and (92) of shoulder (80).

Extension (58) of shoulder (80) has recessed threaded bore (94) corresponding to opening (104) of cutter (100) for receiving bolt (106), thereby fastening cutter (100) to shoulder (80). In operation of this specific embodiment, when it is attached to shoulder (80), extension (58) interlocks with aperture (102) of cutter (100). To those skilled in the art, it is readily seen how the interaction between the elements of connector (60) and shoulder (80) create an adjustable arm (50) for shouldering cutter (100).

By way of example, to enable one skilled in the art to more easily utilize the present invention, selected and specific dimensions of some of the elements of one particular embodiment the finishing device are:

a) Carrier (30)—length 8.57 cm; height 3.18 cm; width 5.08 cm
b) Back plate (40)—length 8.57 cm; height 3.49 cm; width 0.95 cm
c) Catch (32)—length 8.57 cm; height 1.91 cm; width 1.43 cm
d) Connector (60)—length 8.57 cm; height 1.27 cm; width 4.44 cm
e) Rods (86&88)—3.81 cm
f) Jut (68)—length 4.10 cm; depth 0.62 cm; width 4.44 cm
g) Notch (70)—length 4.11 cm; depth 0.63 cm; width 4.44 cm
h) Slot (52)—length 3.33 cm; width 1.11 cm
i) Shoulder (80)—length 8.57 cm; height 4.44 cm; width 1.90; cm
j) Extension (58)—length 1.90 cm; height 4.44 cm; width 0.64 cm
k) Cutter (100)—length 3.49; height 2.22 cm; width 1.11 cm
l) Aperture (102)—length 1.91 cm; height 4.44 cm; width 0.65 cm; and
m) Blade (108&110)—height 2.22 cm; width 1.59 cm; with a contour of 0.95 cm radius.

Having disclosed the invention as required by Title 35 of the United States Code, Applicant now prays respectfully that Letters Patent be granted for his invention in accordance with the scope of the claims appended hereto.

What is claimed is:

1. A tool for mitering a corner of an impression of a profile of a one-piece door, comprising:

a) a cutter contoured for shaping a side of said corner; and b) a carrier for manually moving said cutter against said corner to shape said profile wherein said cutter is aligned with said impression.

2. The invention of claim 1, said carrier further comprising an adjustable arm for shouldering said cutter.

3. The invention of claim 2 wherein a miter line of forty-five degrees relative to the square of said corner is shaped on said side.

4. The invention of claim 3 further comprising a track for positioning said carrier.

5. The invention of claim 4 wherein said cutter is a blade.

6. The invention of claim 5 wherein said one-piece door is a cabinet door.

7. A tool for mitering a corner of an impression of a profile of a one-piece door, comprising:

a) a cutter including a blade contoured for shaping a side of said corner; and b) a carrier for manually moving said cutter against said corner to shape said profile wherein said cutter is aligned with said impression.

8. The invention of claim 7, said carrier further comprising an adjustable arm for shouldering said cutter.

9. The invention of claim 8 wherein a miter line of forty-five degrees relative to the square of said corner is shaped on said side.

10. The invention of claim 9 further comprising a track for positioning said carrier.

11. The invention of claim 9 wherein a first blade is mounted to a first side of said arm and a second blade is mounted to a second side of said arm.

12. The invention of claim 10 wherein said cutter shapes a first side of a first corner and a first side of a second corner of said impression.

13. The invention of claim 11 wherein said one-piece door is a cabinet door.

14. A tool for mitering a corner of an impression of a profile of a one-piece door, comprising:

a) a cutter including a blade contoured for shaping a side of said corner; and b) a carrier, including an adjustable arm for shouldering said cutter, for manually moving said cutter against said corner to shape said profile wherein said cutter is aligned with said impression.

15. The invention of claim 14 wherein a miter line of forty-five degrees relative to the square of said corner is shaped on said side.

16. The invention of claim 14 further comprising a track for positioning said carrier.

17. The invention of claim 16 wherein a first blade is mounted to a first side of said arm and a second blade is mounted to a second side of said arm.

18. The invention of claim 14 wherein said cutter shapes a first side of a first corner and a first side of a second corner of said impression.

19. The invention claim 15 wherein said one-piece door is a cabinet door.

* * * * *